United States Patent [19]

Vergara

[11] Patent Number: 5,027,553

[45] Date of Patent: Jul. 2, 1991

[54] GARAGE DOOR CLOSING APPARATUS

[76] Inventor: Florentino S. Vergara, 2651 Hillsborough Pl., West Covina, Calif. 91792

[21] Appl. No.: 575,874

[22] Filed: Aug. 31, 1990

[51] Int. Cl.[5] ..... E05F 15/20

[52] U.S. Cl. ..... 49/30

[58] Field of Search ..... 49/29, 30, 197, 199, 49/200

[56] References Cited

U.S. PATENT DOCUMENTS

| | | | |
|---|---|---|---|
| 2,807,460 | 9/1957 | Guimont | 49/30 |
| 3,060,361 | 10/1962 | Purdy | 49/30 X |
| 3,510,982 | 5/1970 | Purdy | 49/30 |
| 3,733,747 | 5/1973 | Fox et al. | 49/200 X |
| 4,414,778 | 11/1983 | Carli | 49/199 |
| 4,583,517 | 4/1986 | Hilton et al. | 49/30 X |
| 4,821,024 | 4/1989 | Bayha | 49/30 X |

*Primary Examiner*—Rodney M. Lindsey
*Assistant Examiner*—Jerry Redman
*Attorney, Agent, or Firm*—Boniard I. Brown

[57] ABSTRACT

An add-on device for a motorized garage door opener for automatically closing the door after a delay following the opening of the garage door by a driver and movement of a vehicle out of the garage. The device automatically prevents the door being inadvertently left open, as when a driver forgets to operate a remote controller to close the door.

6 Claims, 1 Drawing Sheet

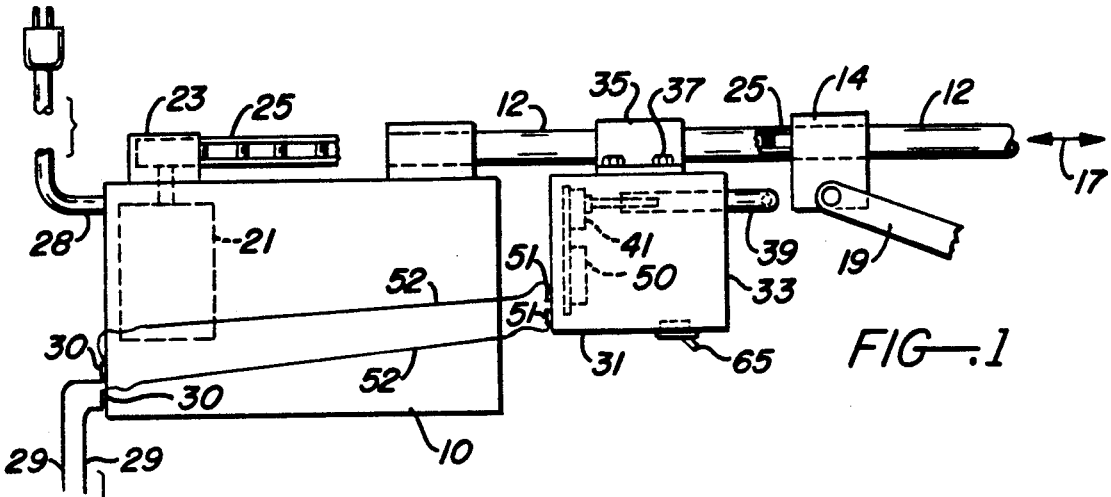
FIG—.1
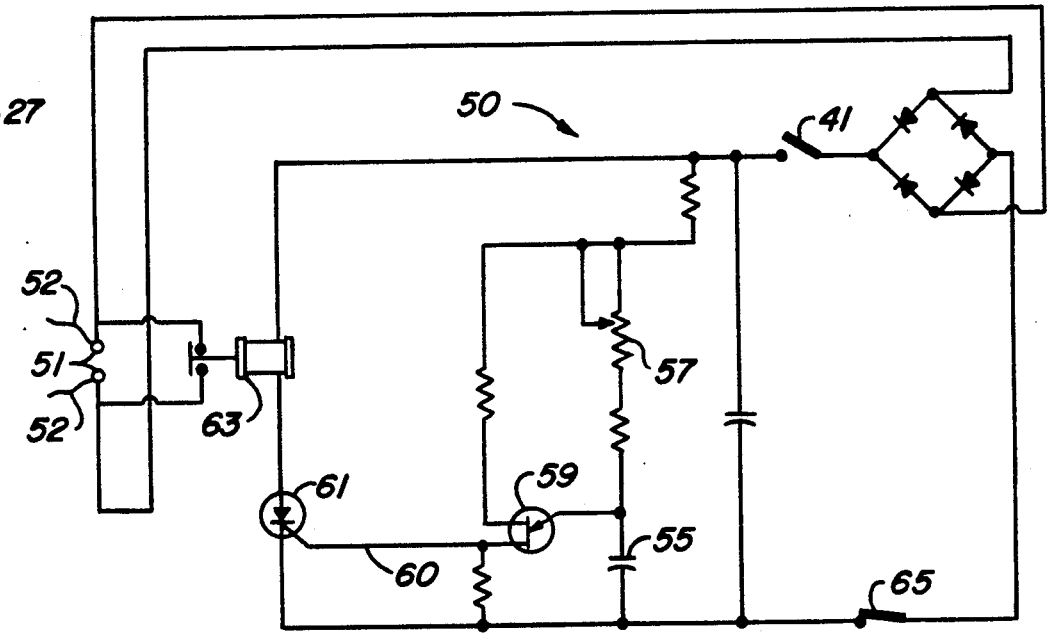
FIG—.2
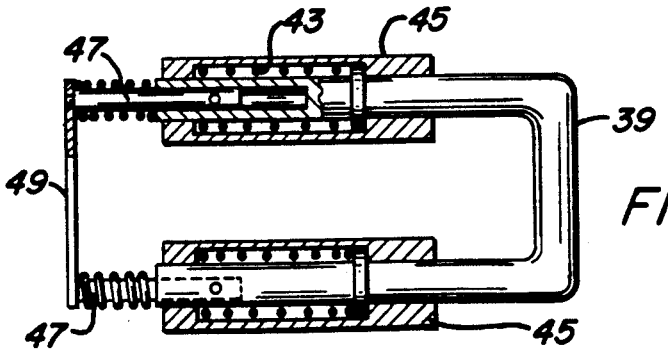
FIG—.3

GARAGE DOOR CLOSING APPARATUS

BACKGROUND AND SUMMARY OF THE INVENTION

The present invention relates to a device for use with a conventional garage door opener to cause the garage door automatically to move to a closed position after being moved to the open position.

Conventional motorized garage door openers often comprise a casing at a central location within the garage approximately seven feet above the garage floor and high enough that a person will not bump his/her head while moving within the garage. A tubular track extends from the casing horizontally to an anchorage point on the garage wall above the garage door opening. A carriage is slidably or rollably positioned on the track for movement therealong. The carriage has a pivotable link-type connection to the inner face of the garage door such that movement of the carriage along the track causes the door to move between a generally horizontal overhead open position within the garage and a vertical closed position closing the garage door opening. Carriage motion can be provided by a chain trained about a sprocket rotatably mounted above the garage door opener casing. An electric motor in the casing drives the sprocket, thus to open or close the door.

The motor can be triggered into operation by a manual switch located in the garage or by a small radio-sending unit in the automotive vehicle. A manual switch on the sending unit actuates a battery-operated radio, thus to generate a momentary signal which is received by a receiving unit in the garage door opener casing. Electrical output from the receiving unit actuates the motor.

A problem with conventional garage door openers is that the driver of a vehicle occasionally will forget to operate the radio-sending unit to close the garage door after he/she has driven the vehicle out of the garage. An open garage door represents potential theft and weather problems.

The present invention relates to a device attachable to a conventional garage door opener for automatically closing the door after the person has driven the vehicle out of the garage. The device includes a time delay mechanism which delays the closing operation for a predetermined period after the door has been opened so that the driver has time to get into the car and drive out of the garage before the door starts to close. The device is designed not to interfere with operation of the garage door opener by the driver, as by manual operation of the radio-sending unit after the car is out of the garage.

BRIEF DESCRIPTION OF THE DRAWINGS

FIG. 1 is a side elevational view of a device embodying the present invention, shown installed on a conventional garage door opener;

FIG. 2 is a diagram of an electrical time delay circuit which may be utilized in the FIG. 1 device; and FIG. 3 is an enlarged sectional view of a switch actuator of the FIG. 1 device.

DESCRIPTION OF A PREFERRED EMBODIMENT OF THE INVENTION

FIG. 1 shows a conventional motorized opener for an overhead garage door. The opener includes a casing 10 adapted to be positioned in an overhead location within a garage (not shown). A tubular track 12 extends horizontally from casing 10 to a point on the garage wall above the garage door opening. The track may have a diameter of about 1¼" and a length of nine or ten feet. A small carriage 14 slidably encircles track 12 for reciprocable movement therealong, as indicated by arrow 17. Carriage 14 is connected to the garage door by a link 19, whereby movement of the carriage along the track causes the door to move between a horizontal open overhead position and a vertical closed position extending across the door opening.

A reversible electric motor 21 within casing 10 has its output shaft extending upwardly through the casing top wall. A sprocket is attached to the exposed portion of the shaft. As shown in FIG. 1, a small cover 23 positioned about the sprocket protects it from dirt and contaminants. A chain 25 is trained about the sprocket, and one end of the chain is attached to carriage 14, whereby operation of the motor causes the carriage to move along track 12. Motor 21 is energized with utility current via a flexible electrical cord 28. The motor operation is triggered by a manual switch 27 mounted on a wall of the garage. Two control wires 29 extend between the switch and two screw-type terminals 30 on casing 10. Switch 27 may be located anywhere within the garage at a convenient location. Momentary depression of the switch 27 button generates a signal (pulse) to trigger the motor into operation, and this motor continues to operate after the person removes his finger from the actuator button.

The present invention relates to an add-on device 31 installation adjacent to casing 10 in alignment with carriage 14. In most conventional garage door opener systems, the carriage is spaced seven or eight inches from the door opener casing when the carriage is at the limit of its motion (in the door-opening direction). There is thus space available for accommodating the device of the invention.

The add-on device comprises a rectangular housing 33 adapted for suspension from track 12. The attachment mechanism may comprise an inverted U-shaped clamp member 35 adapted to fit over and about the track. Bolts 37 extend through flanges on member 35 to attach the clamp member to housing 33.

A deflectable switch actuator 39 is slidably disposed in housing 33 in the path of carriage 14. A normally open switch 41 is arranged within the housing for actuation to its circuit-closed position when actuator 39 is deflected leftwardly by carriage 14. Housing 33 will be located along track 12 so that carriage 14 strikes actuator 39 when the carriage is near the limit of its leftward motion, e.g., less than about one-fourth inch from its limiting position. The limiting position is dictated by the construction of the door opener mechanism.

Actuator 39 may vary in structural configuration. In FIG. 3 the actuator is shown as a rod of circular cross section bent into a U-configuration. The bite portion of the "U" extends transversely of the path of carriage 14, whereby the actuator is certain of being contacted by the carriage. Coil springs 43 encircle the leg portions of the U-shaped rod to normally bias the actuator away from housing 33. Fixed guide structures 45 slidably support the actuator. The actuator can also include two spring-biased pins 47 connected to a transverse plate 49 arranged to contact the operating plunger of switch 41. The spring-biased pins accommodate any overtravel of the actuator mechanism. The arrangement of FIG. 3 is representative of different actuator constructions which may be used.

FIG. 2 shows a conventional time delay circuit 50 that may be utilized. The circuit comprises two screw-type terminals 51 mounted externally on housing 33. Conductor wires 52 extend between terminals 51 and terminals 30. The FIG. 2 circuitry is therefore operationally related to motor 21 in the same manner as switch 27 (FIG. 1). When the circuit across terminals 51 is completed, motor 21 is triggered into operation. The time delay circuit in housing 33 is designed to generate a door-closer signal at terminals 51 after a predetermined delay time measured from the moment actuator 39 is deflected by carriage 14 to close switch 41.

The time delay circuit of FIG. 2 is not new per se. It includes a capacitor 55 and resistance 57 sized to generate a triggering pulse (discharge) into a unijunction transistor 59. A control signal is directed from the unijunction transistor through line 60 to a silicon controlled rectifier 61 in series with the coil of a relay 63. As the relay is energized by the SCR, the relay contacts close to complete a circuit across terminals 51, thus starting motor 21 rotating in the direction for moving carriage 14 rightwardly to the door-closed position.

Rightward motion of carriage 14 does not occur until the delay period has elapsed—i.e., until capacitor 55 has discharged into transistor 59. The delay period can be on the order of two or three minutes—i.e., long enough for a driver to drive the vehicle out of a garage.

The automatic action of the FIG. 2 circuitry may not be desired in every situation. For example, it may be desired to maintain the garage door open for a long period of time. Therefore, a manually-operatable lock-out switch 65 may preferably be provided in the FIG. 2 circuitry to prevent the circuit from having any effect on motor 21. When switch 65 is in the circuit-open position, the FIG. 2 circuit is deactivated.

The device of the invention is designed as a relatively low cost add-on device for a range of different conventional motorized door openers. Wires 52 are the only electrical connections required to operatively install the add-on device. The internal wiring within casing 10 need not be changed or disturbed.

Thus there has been shown and described a novel garage door closing apparatus which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. Apparatus for automatically closing an overhead garage door after a time delay period initiated upon the opening of the door by operation of a garage door opener, said device comprising:

a housing positionable adjacent to a casing of the garage door opener in the path of a movable door carriage, a deflectable switch actuator extending from said housing to intercept the carriage as the carriage nears a position wherein the garage door is fully open, a normally open electric switch means within the housing for actuation to a circuit-closed condition in response to deflection of said actuator by the carriage, time delay circuit means within said housing in circuit with said switch means upon actuation of the switch actuator the said time delay circuit means including two terminals located on the housing, and a relay controlling current flow across said terminals, and external electrical connections extending from said terminals to associated terminals on the garage door opener casing, whereby a time-delayed current flow across said delay circuit terminals acts as a trigger to enable the garage door opener to return the door to its closed position.

2. The door closer apparatus of claim 1, wherein:

said switch actuator is of U-shaped configuration in a top plan view, said switch actuator being so oriented that the U-shape lies in a plane that extends transversely of the door carriage.

3. The door closer apparatus of claim 2, wherein:

said switch actuator comprises two compression coil springs encircling leg portions of the U configuration for normally biasing said actuator away from said housing and toward the carriage.

4. The door closer apparatus of claim 3, wherein:

said actuator is a rod of U-configuration.

5. The door closer apparatus of claim 1, and further comprising:

attachment means carried by said housing for suspending the housing from a carriage-guidance track of the garage door opener.

6. The door closer apparatus of claim 5, wherein:

said attachment means comprises separable clamp members engageable about the guidance track.

* * * * *